United States Patent [19]

Jacob et al.

[11] 4,202,796

[45] May 13, 1980

[54] ANTI-CORROSION COMPOSITION

[75] Inventors: Jose T. Jacob, Lake Zurich, Ill.; Vincent R. Kuhn, Twin Lakes, Wis.

[73] Assignee: Chemed Corporation, Cincinnati, Ohio

[21] Appl. No.: 929,272

[22] Filed: Jul. 31, 1978

[51] Int. Cl.[2] ..... C23F 11/16; C23F 11/14; C23F 11/18

[52] U.S. Cl. ..... 252/389 A; 106/14.16; 106/14.12; 210/58; 252/8.55 E; 252/181; 422/15; 422/16; 422/18

[58] Field of Search ..... 252/389 A, 8.55 E, 181, 252/387; 106/14.12, 14.16, 14.42; 210/58; 422/15, 16, 18

[56] References Cited

U.S. PATENT DOCUMENTS

| | | | |
|---|---|---|---|
| 3,935,125 | 1/1976 | Jacob | 252/389 A |
| 4,101,441 | 7/1978 | Hwa et al. | 252/389 A |
| 4,105,581 | 8/1978 | Sexsmith | 252/389 A |

FOREIGN PATENT DOCUMENTS

| | | |
|---|---|---|
| 659736 | 10/1951 | United Kingdom . |
| 1177134 | 1/1970 | United Kingdom . |

*Primary Examiner*—Benjamin R. Padgett
*Assistant Examiner*—Irwin Gluck
*Attorney, Agent, or Firm*—Charles L. Harness

[57] ABSTRACT

Composition for prevention of ferrous corrosion consisting essentially of (a) sorbitol, (b) benzotriazole or tolyltriazole, and (c) a water-soluble phosphate.

11 Claims, No Drawings

ANTI-CORROSION COMPOSITION

The present invention relates to novel and improved corrosion inhibiting compositions and methods of inhibiting corrosion. The invention provides corrosion protection for metal parts such as heat exchangers, engine jackets, pipes and prevents metal loss, pitting and tuberculation of iron base alloys which are in contact with water.

The invention is directed to a relatively non-toxic, non-chromate, non-zinc corrosion inhibiting composition which is capable of protecting ferrous metals from the corrosion, said composition consisting essentially of (a) sorbitol, (b) benzotriazole or tolyltriazole, and (c) water-soluble phosphates, e.g., phosphoric acid, disodium phosphate, sodium tripolyphosphate, or tetrapotassium pyrophosphate. This mixture can be blended with any well known scale inhibitors or dispersants. The prior art teaches the use of benzotriazole and water soluble phosphate as corrosion inhibitors for aqueous systems. But the protection offered for ferrous metals with this composition is not beyond criticism. We have now discovered that the addition of sorbitol to such a composition significantly improves the protection of ferrous metals in aqueous systems. Typical industrial applications where the instant invention is useful include water treatment, acid pickling, radiator coolant, hydraulic liquid, anti-freeze, heat transfer medium, and petroleum well treatment.

TEST PROCEDURE AND EXAMPLES

In these tests, circulating water having the following composition was used.

| | |
|---|---|
| Calcium sulfate dihydrate | 714 ppm |
| Magnesium sulfate heptahydrate | 519 ppm |
| Sodium bicarbonate | 185 ppm |
| Sodium chloride | 989 ppm |

During the tests, the circulating water was fed to a closed circulating test system at a rate of 5 gallons per day, the overflow from the test system being discharged to waste.

In the closed circulating system, circulating water having a temperature of 130° F. and a pH of 7.0–8.0 was fed at a rate of one gallon per minute to a coupon chamber containing test coupons for the corrosion test. The total circulating time for each test was 10 days.

Mild steel, brass (33 wt. percent zinc), and copper coupons having an average area of 26.2 cm.$^2$ were used in the test chamber. The coupons were carefully cleaned and weighed before use. The components stated below were added to the circulating water at the levels indicated, for each of the tests, as stated. Following the tests, each coupon was cleaned with inhibited hydrochloric acid, rinsed, dried and weighed to determine the corrosion rate in mils per year.

The results obtained are shown in the following Table.

| Example | Test Conditions Addition (ppm) | Cooling Water System, pH 7–7.5, 130° F., 10 days Corrosion Rate in Mils per year Steel | Copper | Brass |
|---|---|---|---|---|
| 1 | Blank (no treatment) | 19.6 | 1.1 | 1.7 |

-continued

| Example | Test Conditions Addition (ppm) | Cooling Water System, pH 7–7.5, 130° F., 10 days Corrosion Rate in Mils per year Steel | Copper | Brass |
|---|---|---|---|---|
| 2 | BT 2 ppm | 20.0 | 0.2 | 0.2 |
| 3 | BT 10 ppm | 19.2 | 0.2 | 0.2 |
| 4 | $H_3PO_4$ 4 ppm | 20.0 | 0.56 | 0.36 |
| 5 | Sorbitol 5 | 20.0 | 0.8 | 0.3 |
| 6 | BT 3 ppm + Sorbitol 5 ppm | 14.9 | 1.8 | 0.6 |
| 7 | BT 3 ppm + phosphoric acid 4 ppm | 10.1 | 0.5 | 1 |
| 8 | Sorbitol 5 ppm + $H_3PO_4$ 4 ppm | 9.4 | 1.5 | 0.6 |
| 9 | Sorbitol + $H_3PO_4$ + BT 5 4 3 | 2.8 | 0.5 | 0.6 |
| 10 | Sorbitol + $H_3PO_4$ + BT 5 4 3 | 3 | 0.6 | 0.2 |
| 11 | Sorbitol + $H_3PO_4$ + BT 6 4 3 | 2.7 | 0.25 | 0.3 |

Preferred formulations are as follows:

| Ex. 12 | Liquid Formulation | |
|---|---|---|
| | Deionized water | 12.8% |
| | Phosphoric acid (75%) | 10.0% |
| | Ethane-1-hydroxy-1,1-diphosphonic acid (40%) | 15.0% |
| | Sorbitol | 10.0% |
| | Potassium hydroxide (45%) | 46.2% |
| | Tolytriazole | 6.0% |
| | | 100.0% |

| Ex. 13 | Powder Formulation | |
|---|---|---|
| | Sodium phosphate (Mono basic) Monohydrate | 15.84% |
| | Ethane-1-hydroxy-1,1-diphosphonic acid | 8.04% |
| | Benzotriazole | 9.00% |
| | Sorbitol | 15.00% |
| | Sodium sulfate | 36.47% |
| | Sodium carbonate | 15.65% |
| | | 100.00% |

In the composition, the preferred weight ratio of sorbitol:benzotriazole or tolyltriazole:water-soluble phosphate is 0.01 to 100:0.01 to 100:1. Even more preferably it is 0.1 to 10:0.1 to 10:1. These same ratios are applicable to levels of the compounds in water, where the phosphate is preferably maintained at about 0.01 to 5000 ppm, and even more preferably about 0.1 to 50 ppm.

We claim:

1. Composition consisting essentially of
(A) sorbitol;
(B) a member selected from the group consisting of benzotriazole and tolyltriazole; and
(C) a water-soluble phosphate.

2. Composition according to claim 1 in which the weight ratio of A:B:C is about 0.01 to 100 : 0.01 to 100 :1.

3. Composition according to claim 2 in which the weight ratio of A:B:C is about 0.1 to 10 : 0.1 to 10 :1.

4. Composition according to claim 1 in which the group member is benzotriazole.

5. Composition according to claim 1 in which the group member is tolyltriazole.

6. Composition according to claim 4, consisting essentially of

| | |
|---|---|
| Sodium phosphate (Mono basic) Monohydrate | 15.84% |
| Ethane-1-hydroxy-1,1-diphosphonic Acid | 8.04% |
| Benzotriazole | 9.00% |
| Sorbitol | 15.00% |
| Sodium sulfate | 36.47% |
| Sodium carbonate | 15.65% |

7. Composition according to claim 5, consisting essentially of

| | |
|---|---|
| Deionized water | 12.8% |
| Phosphoric acid (75%) | 10.0% |
| Ethane-1-hydroxy-1,1-diphosphonic acid (40%) | 15.0% |
| Sorbitol | 10.0% |
| Potassium hydroxide (45%) | 46.2% |
| Tolytriazole | 6.0% |

8. Process of inhibiting ferrous corrosion in an aqueous system comprising maintaining therein (A) sorbitol; (B) a member selected from the group consisting of benzotriazole and tolyltriazole; and (C) a water-soluble phosphate, wherein the weight ratio of the components A:B:C is 0.01 to 100 : 0.01 to 100 :1, and component C is maintained at about 0.01 to 5000 ppm.

9. Process according to claim 8 in which the group member is benzotriazole.

10. Process according to claim 8 in which the group member is tolyltriazole.

11. Process according to claim 8 in which the A:B:C ratio is 0.1 to 10 : 0.1 to 10 : 1.

* * * * *